US006247186B1

(12) United States Patent
Huang

(10) Patent No.: US 6,247,186 B1
(45) Date of Patent: Jun. 19, 2001

(54) HELMET WITH VENTILATION ARRANGEMENT

(76) Inventor: I-Chuan Huang, P.O. Box 55 - 175, Taichung (TW)

( * ) Notice: Subject to any disclaimer, the term of this patent is extended or adjusted under 35 U.S.C. 154(b) by 0 days.

(21) Appl. No.: 09/664,759

(22) Filed: Sep. 19, 2000

(30) Foreign Application Priority Data

Dec. 21, 1999 (CN) ..... 99252159

(51) Int. Cl.[7] ..... A42B 1/06; A63B 71/10
(52) U.S. Cl. ..... 2/410; 2/425; 2/171.3
(58) Field of Search ..... 2/410, 425, 171.3

(56) References Cited

U.S. PATENT DOCUMENTS 4,115,374 * 9/1978 Hasegawa ..... 2/425
4,612,675 * 9/1986 Broersma ..... 2/425 X
4,627,115 * 12/1986 Broersma ..... 2/425
4,700,411 * 10/1987 Kawasaki et al. ..... 2/425
5,165,116 * 11/1992 Simpson ..... 2/410 X
5,345,614 * 9/1994 Tanaka ..... 2/425
5,361,419 * 11/1994 Bernstein ..... 2/425 X
5,687,426 * 11/1997 Sperber ..... 2/425 X
5,734,994 * 4/1998 Rogers ..... 2/425 X

FOREIGN PATENT DOCUMENTS

586932 A2 * 3/1994 (EP) ..... 2/410

* cited by examiner

*Primary Examiner*—Rodney Lindsey

(57) ABSTRACT

A helmet with ventilation arrangement comprises a housing, an inner honey-comb like impact resistant layer shaped to the head of rider, a protective covering spaced above and formed integrally with the housing, and a chamber enclosed by housing and protective covering being open to outside in the front side for introducing air therein. Chamber has a net strap in the front side for preventing foreign objects from entering and one or more inner channels being in communication with the inner space of helmet through a passageway. In riding a motorcycle, air may enter into chamber. Moreover, such fresh air flows through channel passageway, and honeycomb-like impact resistant layer so as to be in contact with every part of the head of rider.

8 Claims, 5 Drawing Sheets

HELMET WITH VENTILATION ARRANGEMENT

FIELD OF THE INVENTION

The present invention relates to motorcycle helmets and more particularly to a motorcycle helmet with improved ventilation characteristics.

BACKGROUND OF THE INVENTION

Many countries have promulgated laws to enforce a motorcycle rider wear helmet while driving. However, wearing helmet is not a comfortable thing as regarded by motorcycle rider. This is because most conventional helmets are not ventilated well. Thus a motorcycle rider often gives forth a lot of sweat while driving especially in the summer. This may frustrate the desire of wearing helmet by a motorcycle rider.

Thus, it is desirable to provide a helmet with improved ventilation arrangement in order to overcome the above drawback of prior art.

SUMMARY OF THE INVENTION

It is an object of the present invention to provide a helmet with ventilation arrangement comprising a housing, an inner honeycomb-like impact resistant layer shaped to the head of rider, a protective covering spaced above and formed integrally with the front, rear, and two sides of housing, and a chamber enclosed by housing and protective covering being open to outside in the front side for introducing air therein. Chamber has a net strap in the front side for preventing foreign objects from entering and one or more inner channels being in communication with the inner space of helmet through a passageway. In riding a motorcycle by a rider wearing the helmet of the present invention, air may enter into chamber. Moreover, such fresh air flows through channel, passageway, and honeycomb-like impact resistant layer so as to be in contact with every part of the head of rider. This can lower the temperature inside helmet for providing a degree of comfort to the rider.

The above and other objects, features and advantages of the present invention will become apparent from the following detailed description taken with the accompanying drawings.

DETAILED DESCRIPTION OF THE PREFERRED EMBODIMENTS

Figure 1:
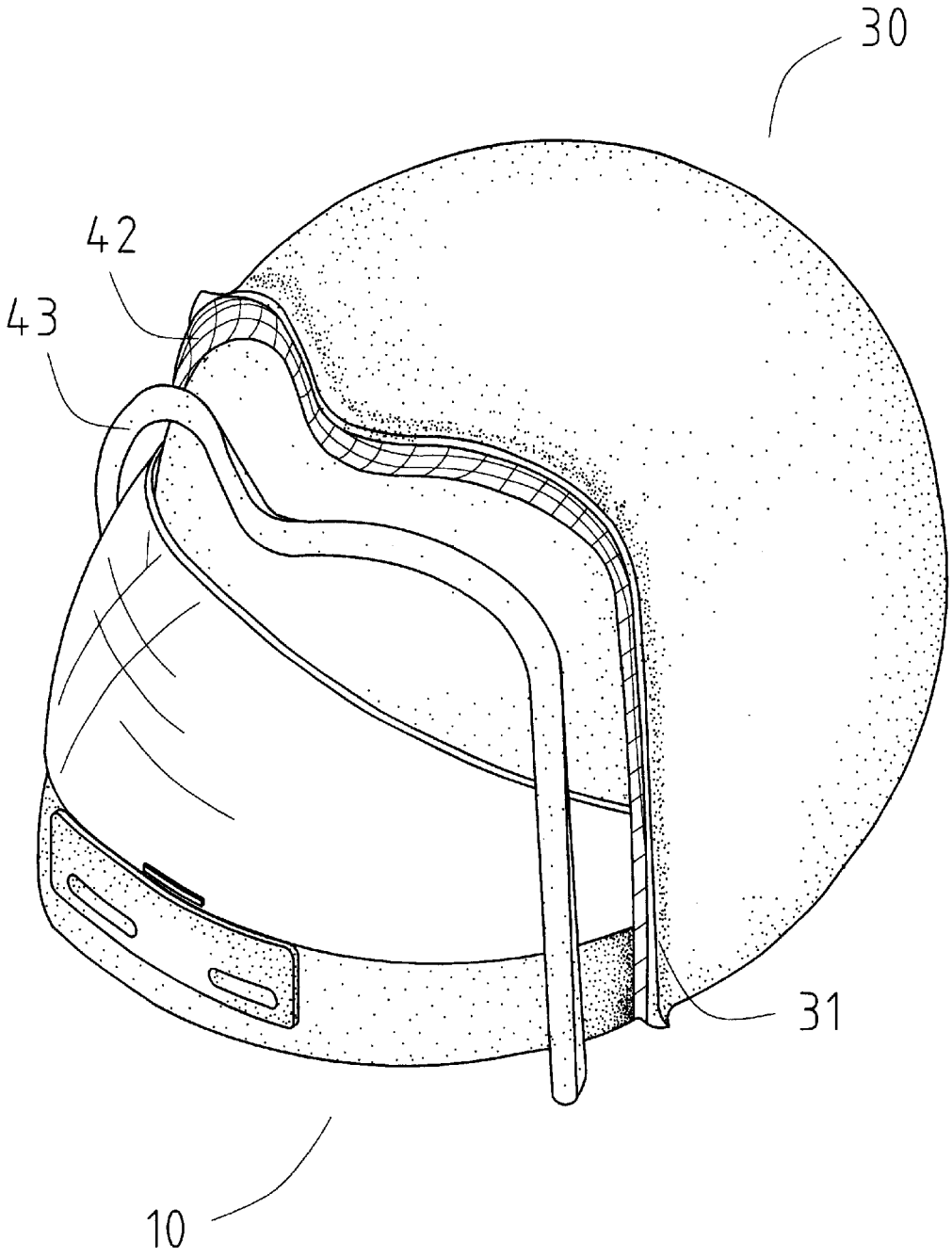
FIG. 1 is a perspective view of a first preferred embodiment of helmet according to the present invention.
Figure 2:
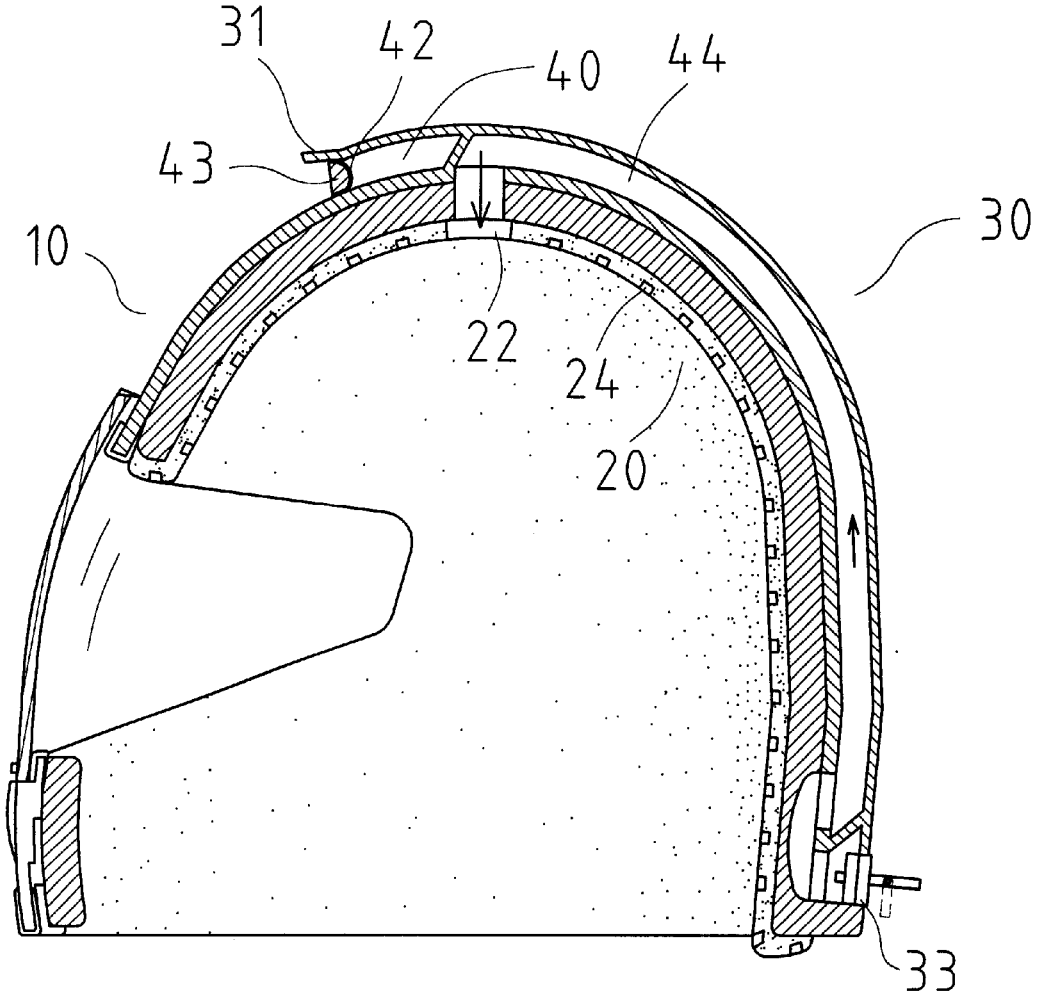
FIG. 2 is a cross-sectional view of the FIG. 1 helmet.
Figure 3:
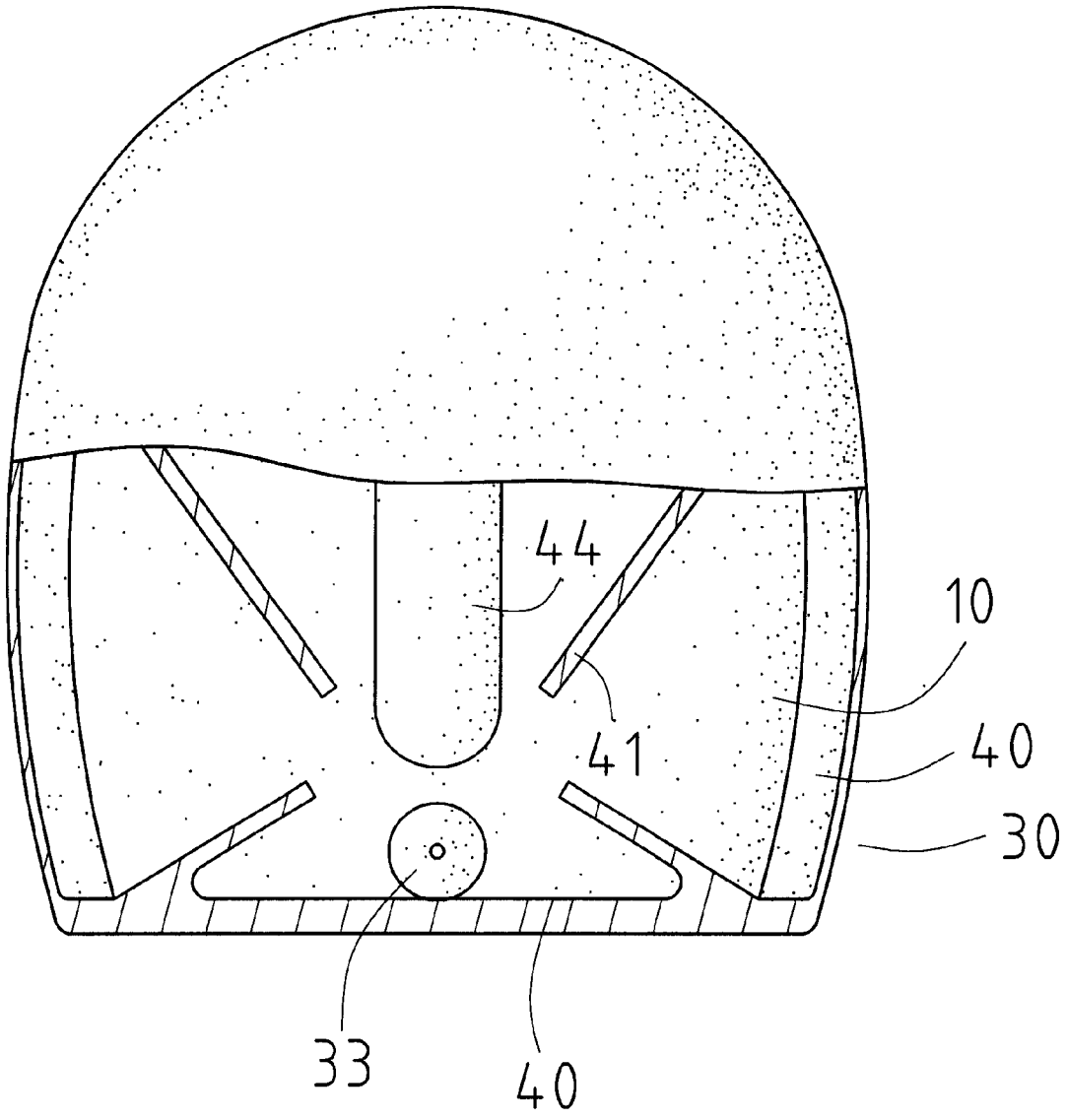
FIG. 3 is a rear view of the FIG. 1 helmet with a portion removed to show the interior features.
Figure 4:
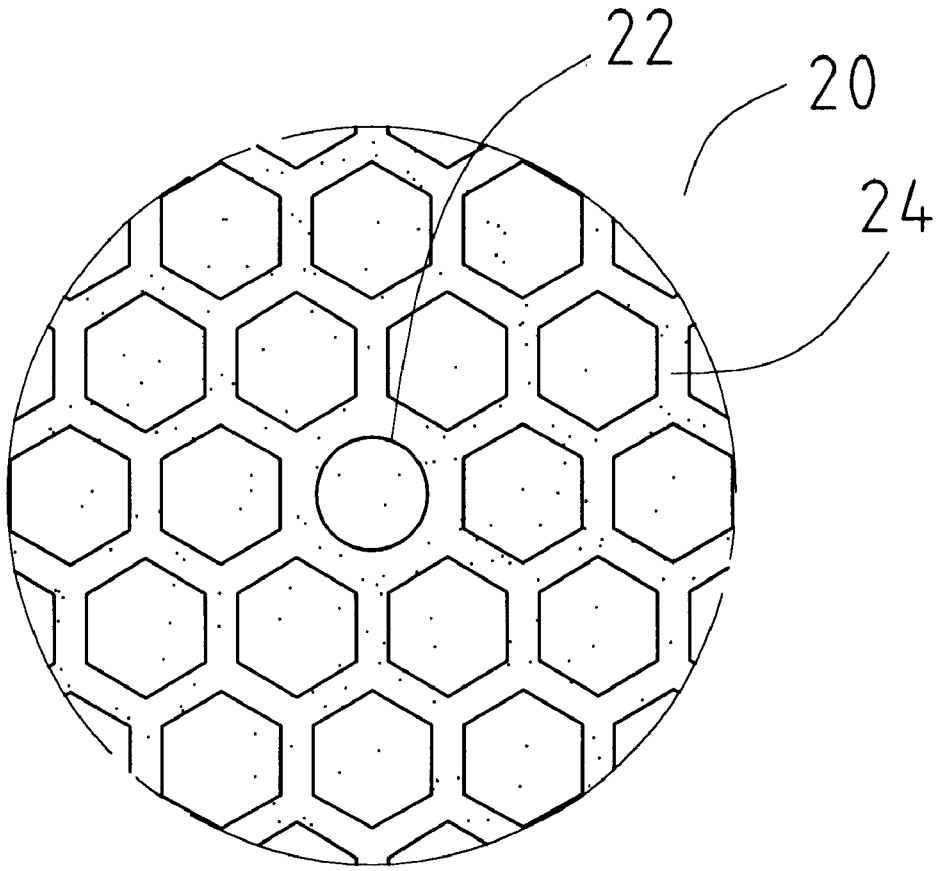
FIG. 4 is an enlarged fragmentary plan view of the impact resistant layer of the FIG. 1 helmet.

Referring to FIGS. 1 to 4, there is shown a helmet constructed in accordance with the present invention comprising a housing 10, an inner impact resistant layer 20 shaped to the head of rider, a protective covering 30 spaced above and formed integrally with the front, rear, and two sides of housing 10, and a chamber 40 enclosed by housing 10 and protective covering 30 wherein the front of chamber 40 is open to outside for introducing air therein. Chamber 40 comprises a plurality of ribs 41 connected between protective covering 30 and housing 10 for supporting chamber 40 and enhancing the structural strength of protective covering 30. Protective covering 30 comprises a front brim formed as spoiler 31 for increasing air introduced into chamber 40. Chamber 40 has a net strap 42 adjacent spoiler 31 in the front for preventing foreign objects from entering into chamber 40. Optionally, a flexible strap 43 is provided in front of net strap 42 wherein the shape of the rear side of strap 43 is conformed to that of the front side of net strap 42 for sealing chamber 40 for example in a rainy day or severe weather. This can prevent rain or cold wind from entering into chamber 40 so as to provide a comfort to the rider. A plunger 33 is formed in the rear of protective covering 30 for communicating air with chamber 40.

A channel 44 is formed in chamber 40. The bottom end of channel 44 is in the rear of housing 10 being in communication with chamber 40 and plunger 33, while the front end of channel 44 is extended to the front center of housing 10 being in communication with the inner space of helmet (i.e., the space occupied by the head of motorcycle rider) through passageway 22 which passes housing 10. A plurality of meshlike paths 24 are formed in the inner surface of impact resistant layer 20 being in communication with passageway 22. These meshlike paths 24 form a honeycomb shape in the inner surface of impact resistant layer 20.

In riding a motorcycle by a rider wearing a helmet, air may enter into chamber 40 if strap 43 is removed (in most cases). Such fresh air further flows through channel 44, passageway 22, and paths 24 so as to be in contact with every part of the head of rider. This can lower the temperature inside helmet for providing a degree of comfort to the rider.

Figure 5:
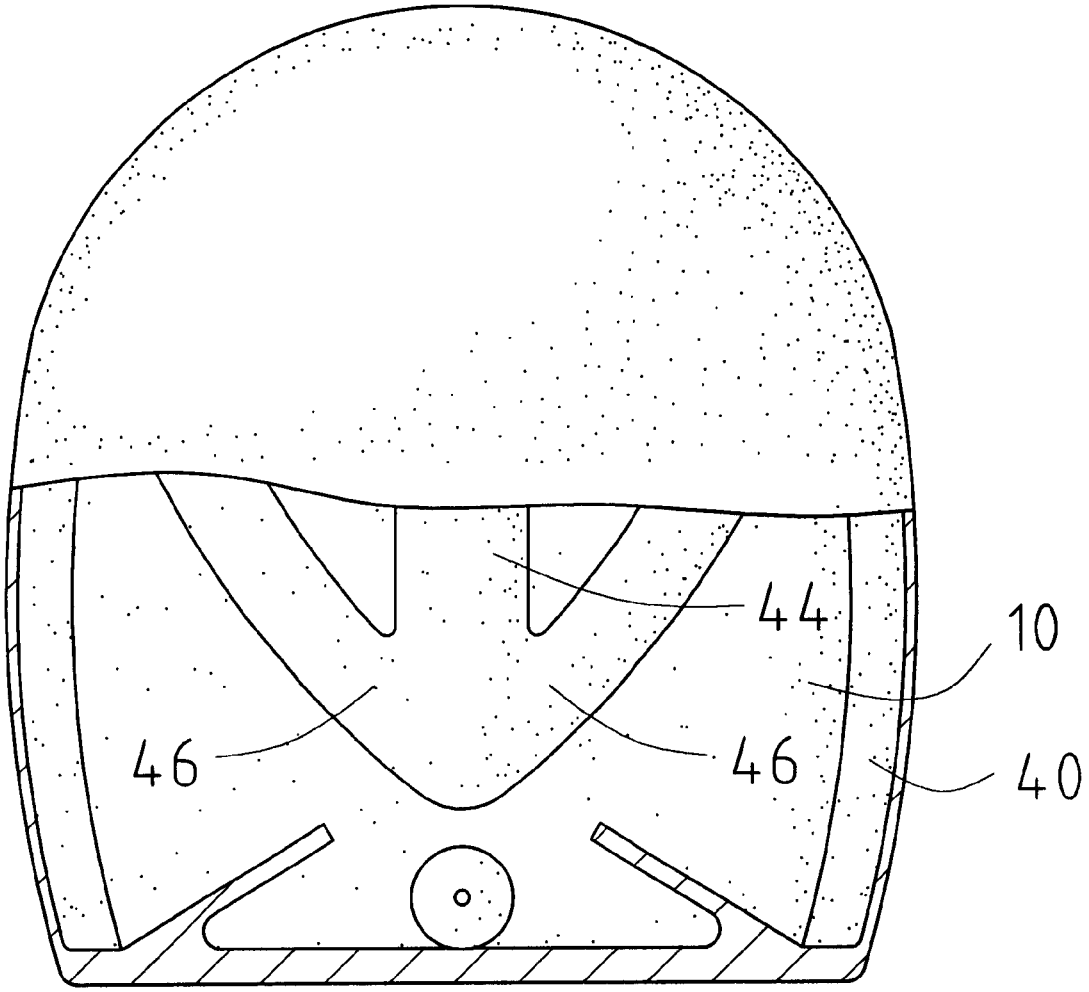
FIG. 5 is a rear view of a second preferred embodiment of helmet according to the present invention wherein a portion removed to show the interior features.

Referring to FIG. 5, there is shown a second preferred embodiment of helmet according to the present invention. Helmet of this embodiment is generally the same as that of the first embodiment except that there are two additional channels 46 provided. These three channels 44 and 46 have the rear ends joined in the rear of housing 10 being in communication with chamber 40 and the front ends extended to the front center of housing 10 being in communication with the inner space of helmet through passageway 22.

While the present invention has been described by means of specific embodiments, numerous modifications and variations could be made thereto by those skilled in the art without departing from the scope and spirit of the invention set forth in the claims.

What is claimed is:

1. A helmet worn by a motorcycle rider comprising:

a housing;

an inner honeycomb-like impact resistant layer shaped to the head of the rider including a passageway on the top;

a protective covering spaced above and formed integrally with the housing; and a chamber enclosed by the housing and the protective covering being open to outside in the front side, the chamber including an inner first channel having one end in communication with the inner space of the helmet through the passageway, wherein when the helmet is moving, air is introduced into the chamber to flow through the first channel and the passageway so as to be in contact with every part of the head of the rider.

2. The helmet according to the claim 1, wherein the impact resistant layer further comprises a plurality of mesh-like paths in the inner surface being in communication with the passageway.

3. The helmet according to the claim 1, further comprising a net strap in the front side of the chamber for preventing foreign objects from entering into the chamber.

4. The helmet according to the claim 1, further comprising a flexible strap in front of the chamber for sealing the chamber.

5. The helmet according to the claim 1, further comprising a spoiler in the front brim of the protective covering for increasing air introduced into the chamber.

6. The helmet according to the claim 1, wherein the chamber further comprises a plurality of ribs connected between the protective covering and the housing for supporting the chamber and enhancing the structural strength of the protective covering.

7. The helmet according to the claim 1, further comprising a plunger in the rear of the protective covering for communicating air with the first channel.

8. The helmet according to the claim 1, further comprising two second channels together with the first channel having the rear ends joined in the rear of the housing being in communication with the chamber and the front ends extended to the front center of the housing being in communication with the inner space of the helmet through the passageway.

* * * * *